US006314844B1

(12) United States Patent
Warner

(10) Patent No.: US 6,314,844 B1
(45) Date of Patent: Nov. 13, 2001

(54) UNI-HEX KEY WRENCH

(75) Inventor: Mark S. Warner, Mission Viejo, CA (US)

(73) Assignees: Mark Warner; Paul W. Petersen, both of Mission Viejo, CA (US)

( * ) Notice: Subject to any disclaimer, the term of this patent is extended or adjusted under 35 U.S.C. 154(b) by 0 days.

(21) Appl. No.: 09/542,824

(22) Filed: Apr. 4, 2000

(51) Int. Cl.[7] ..... B25B 23/00
(52) U.S. Cl. ..... 81/440; 81/177.6
(58) Field of Search ..... 81/440, 450, 177.6, 81/177.7, 177.8

(56) References Cited

U.S. PATENT DOCUMENTS

| | | | | |
|---|---|---|---|---|
| 2,951,405 | * | 9/1960 | Engquist | 81/440 |
| 3,892,149 | * | 7/1975 | Rydberg | 81/71 |
| 4,699,030 | * | 10/1987 | Yang | 81/440 |
| 4,848,197 | * | 7/1989 | Kikel | 81/440 |
| 5,926,885 | * | 7/1999 | Williams | 7/165 |
| 5,943,925 | * | 8/1999 | Huang | 81/177.2 |

FOREIGN PATENT DOCUMENTS

| | | | | |
|---|---|---|---|---|
| 2050899 | * | 1/1981 | (GB) | 81/450 |

* cited by examiner

*Primary Examiner*—Joseph J. Hail, III
*Assistant Examiner*—David B. Thomas
(74) *Attorney, Agent, or Firm*—Charles C. H. Wu; Charles C. H. Wu & Associates

(57) ABSTRACT

A wrench comprising two driving stems pivotally connected with each other. One of the driving stems has a main body and a flat portion, protruding from the main body with a hole at a center thereof. The other driving stem has the other main body and the other flat portion protruding from the other main body with at a center thereof. A pair of hinges having two holes aligned with the holes of the flat portions protruding from the main bodies of the driving stems, respectively, is used. Two sets of bolts and nuts are used to be threaded through the holes of the hinges, the flat portion protruding from main bodies of the first and the second driving stems, respectively.

14 Claims, 12 Drawing Sheets

UNI-HEX KEY WRENCH

BACKGROUND OF THE INVENTION

1. Field of the Invention

The invention relates in general to a wrench having two driving stems pivotally connected with each other. More particularly, this invention relates to a hex key type or Allen wrench having two individual driving stems pivotally connected with each other.

2. Description of the Related Art

A conventional wrench, for example, an Allen wrench, used for gripping and turning or twisting the head of a bolt, a nut, a pipe, or the like commonly typically comprises a one-piece L-shape metal with one end used as the driving stem and the other end used as a handle.

In U.S. Pat. No. 5,943,925, Huang discloses a tool having a foldable structure. The foldable structure disclosed by Huang comprises a coupler pivotally coupled between a driving stem and a handle. Applying the foldable structure to the Allen wrench, the driving stem can be folded in parallel with the handle, that is, with a zero angle relative to the handle. This results in a more compact space for storing the tool. In Huang, with respect to the handle, the driving stem can be rotated from an angle of zero degree to an angle of 180 degree. While turning a bolt in a limited space, for example, around the boundary of two perpendicularly adjoining planes, the handle of the Allen wrench adopting the foldable structure disclosed by Huang can only be turned between zero degree to 180 degrees along a surface perpendicular to the driving stem. When a half circle of the turning action is complete, the user has to disengage the wrench from the bolt. By repositioning the handle to the original point of the turning action, the turning action is repeated until the bolt is fastened as required. In other words, while tightening/untightening a screw, a bolt or a nut in a plane with a limited degree of freedom, a user may need to repeat engaging and disengaging the driving stem to reposition the handle. Moreover, using this conventional structure, there is only one end of the wrench that can be used as the driving tool while the other end is used as a handle only. When a different torque is required, or a screw, a bolt or a nut with different depth is to be driven thereby, a different driving stem has to be connected and reassembled.

SUMMARY OF THE INVENTION

The invention provides a wrench having two driving stems pivotally connected with each other. One of these two pivotally connected driving stems flips from an angle of about 90 degrees to an angle of about 270 degrees relative to the other.

Thus arranged, one of the driving stems used as a handle can flip with an angle from about 90 degrees to about 270 degrees with respect to the other of the driving stems used for driving a screw or a bolt. Therefore, when the rotation of the handle is obstructed, the handle can be lifted up or down to perform fastening or removing. The specific flipping angle of the handle actually depends on the distance between the adjoining ends of the driving stems. That is, with sufficient clearance between adjoining ends, the handle can also be flipped from an angle less than 90 degree to an angle larger than 270 degrees.

The applicability of the wrench structure provided by the invention is also applicable for driving a screw or a bolt in a space with limited degree of freedom, for example, in the situation that the rotation of the handle is obstructed by the presence of an object. As an example, while driving a bolt on a plane with a second plane protruding nearby, the bolt is engaged with the driving stem, and the handle is turned to drive the driving stem, so as to thread/unthread the bolt. Being obstructed by the protruding object, the rotating range of the handle is limited within a certain angle along a surface parallel to the first plane. When the rotating action of the handle is from one end to the other, that is, from an angle of zero degree to the certain degree along the surface, the user does not need to disengage the driving stem from the bolt. Instead, the user can simply flip the handle to the other end, that is, from the angle of 90 degree to 270 degree relative to the driving stem, and carry on driving the bolt.

In addition, with the structure of two driving stems pivotally connected together, one may choose either one of the driving stems as a handle, and the other driving stem to engage and drive an object, for example, a screw, a nut, a bolt or the like. With object with different depth to be engaged and driven, or when a different torque is required, one may interchange the functions of these two driving stems.

Both the foregoing general description and the following detailed description are exemplary and explanatory only and are not restrictive of the invention, as claimed.

DESCRIPTION OF THE PREFERRED EMBODIMENTS

FIGS. 1 to 19 illustrate the present embodied by a hex-key type or Allen wrench with two driving stems pivotally connected with each other. Being pivotally connected, one of the driving stems is used as a handle to drive the other driving stem, an object such as a nut, a screw or a bolt can be threaded or unthreaded. When one is threading/unthreading the object, the handle can be flipped from an angle of about 90 degree to about 270 degree with respect to the driving stem used to thread/unthread the object. In this manner, even with the presence of an object that obstructing the threading/unthreading operation, the user does not need to disengage the object and rotate the handle to carry on threading/unthreading. Instead, one can simply flip over the handle and repeat rotating the handle to complete the threading/unthreading operation. In addition to the application of a hex-key or Allen wrench, it is appreciated that people of skill in the art may modify the disclosure of this embodiment and apply to other driving tool such as a box wrench, an open-end wrench, a socket wrench, or the like.

Figure 1:
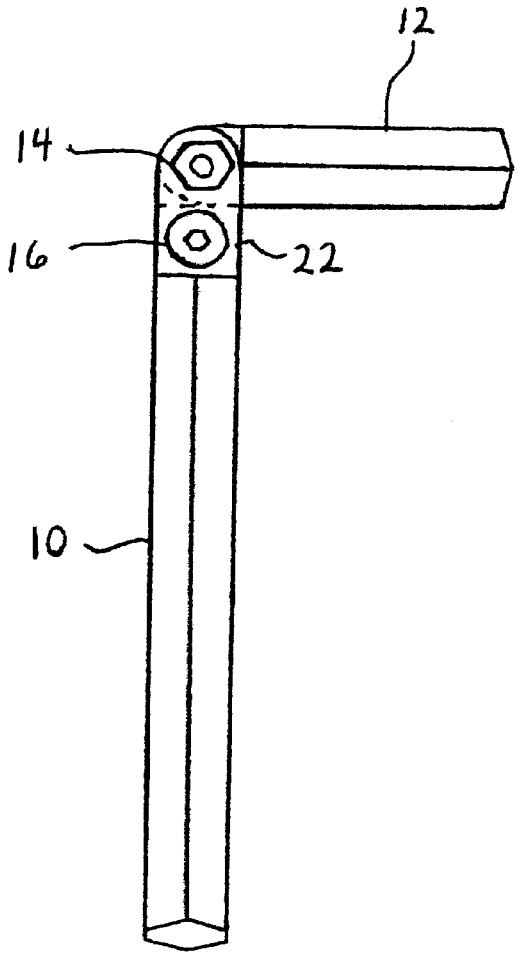
FIG. 1 is a side view of a wrench with one driving stem positioned perpendicularly to the other driving stem in accordance with the present invention.
Figure 4:
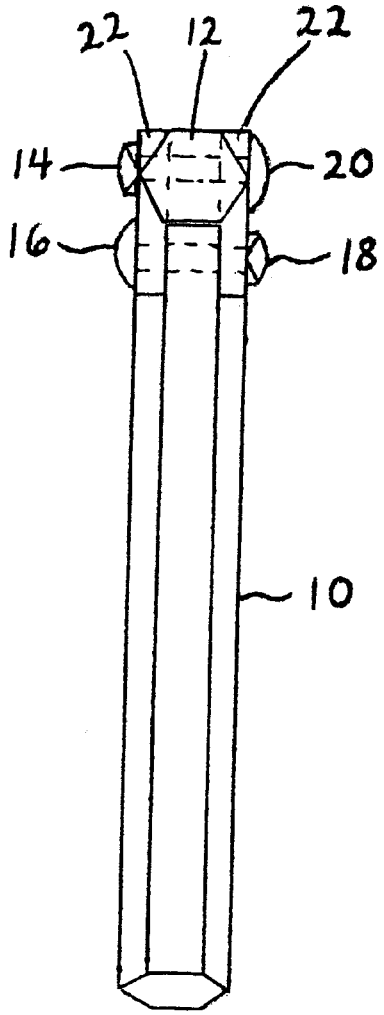
FIG. 4 is a front view of a wrench with one driving stem positioned perpendicularly to the other driving stem in accordance with the present invention.

FIG. 1 shows a side view of the wrench comprising two driving stems pivotally connected with each other. In this embodiment, two sets of bolts and nuts are used to thread through each of the driving stems. As shown in FIG. 1, when a bolt 16 is threaded into the observed side of the lower driving stem 10, a nut 14 is threaded from the same side of the upper driving stem 12. The alternate usage of the bolts 16, 20 and nuts 14, 18 can be clearly observed from a front view as shown in FIG. 4. FIGS. 1 and 4 both show the wrench with the driving stems 10, 12 positioned perpendicularly with each other.

Figure 2:
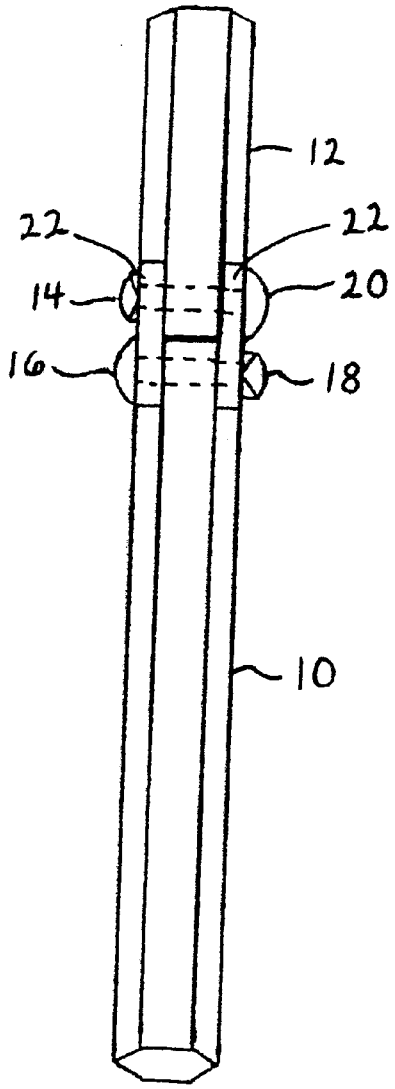
FIG. 2 is a front view of a wrench with one driving stem in line with the other in accordance with the present invention.
Figure 3:
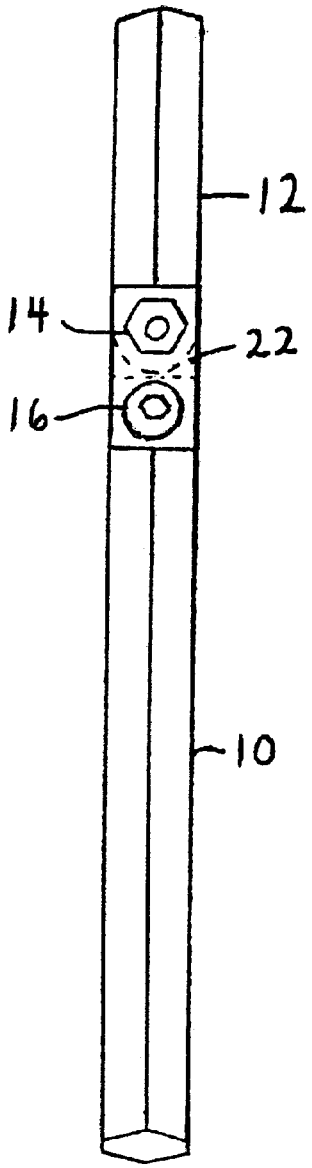
FIG. 3 is a side view of a wrench with one driving stem in line with the t other in accordance with the present invention.

FIGS. 2 and 3 shows both the side view and the front view of the wrench as shown in FIGS. 1 and 4, whereas, the driving stems 10 and 12 are in line with each other. In addition, two sets of bolts 16 and 20, and nuts 14 and 18, and a pair of washers or hinges 22, are used to connect the driving stems 10 and 12. Referring to FIGS. 1–4, the washers or hinges 22 are connected between the driving stems 10 and 12 with bolts 16 and 20 and nuts 14 and 18 threading through the washers or hinges 22 and the driving stems 10 and 12.

Figure 5:
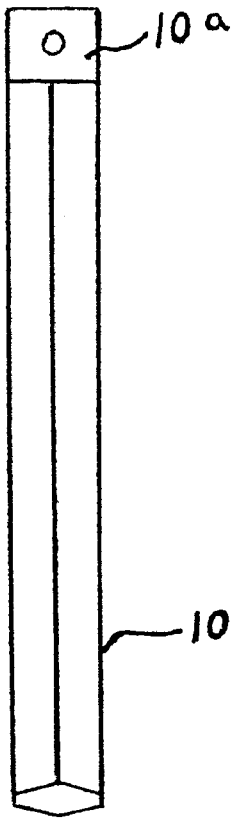
FIG. 5 is a side view of one of the driving stems.
Figure 6:
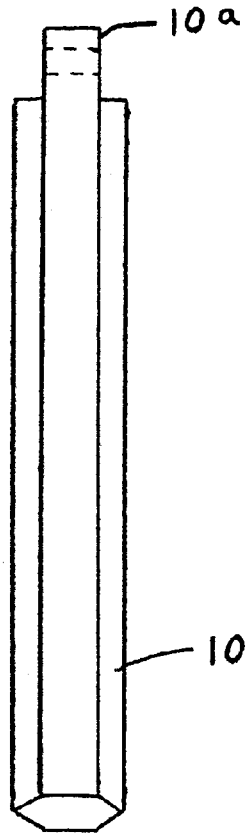
FIG. 6 is a front view of the driving stem as shown in FIG. 5.

FIG. 5 shows an exploded side view the lower driving stem 10. As shown in this figure, at the top end of the driving stem 10, a flat portion 10*a* protrudes from the center of the main body. In the example of a hex key, the width of the flat portion 10*a* is preferably equal to the width of one of the six sides. FIG. 6 is a front view of the lower driving stem 10. The flat part 10*a* protrudes from center side of the observed three sides of the main body.

Figure 7:
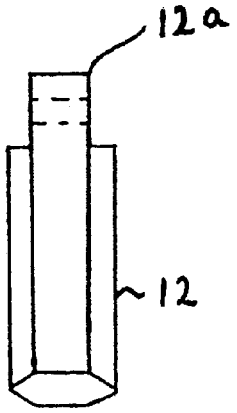
FIG. 7 is a front view of the other driving stem.
Figure 8:
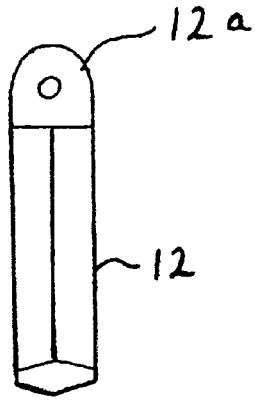
FIG. 8 is a side view of the other driving stem as shown in FIG. 7.

FIG. 7 and 8 show the front view and side view of the upper driving stem 12. The structure of the upper driving stem 12 is similar to the structure of the lower driving stem 10 except that the protruding portion 12*a* has the rounded corners.

Figure 9:
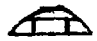
FIG. 9 is a perspective view of a head of one of the bolts that couple two driving stems.
Figure 10:
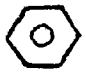
FIG. 10 is a plan view of a nut used to couple two driving stems.
Figure 11:
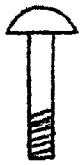
FIG. 11 is a side view of the bolt used to couple two driving stems.
Figure 12:
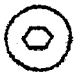
FIG. 12 is a top view of the hat of the bolt as shown as FIG. 11.
Figure 13:
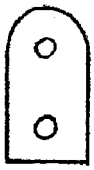
FIG. 13 is a plan view of a hinge used to couple the driving stems.
Figure 14:
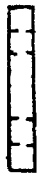
FIG. 14 is a side view of the hinge as shown in FIG. 13.

FIGS. 9–10 show the side view and top view of a dome shaped nut, and FIGS. 11–12 show the side view and the top view of a bolt. FIGS. 13–14 show the front view and the side view of the hinges. Preferably, the protruding portions of the lower and the upper driving stems are the same, and the length of the hinge connected between two driving stems is slightly larger than the length of the protruding portions to allow one of the driving stems to flip over the other one. However, the actual length of the hinge can be varied according to specific requirements. As a result, the specific flipping angle of the handle actually depends the distance between the driving stems, or the length of the hinge. That is, the handle can also be flipped from an angle less than 90 degree to an angle larger than 270 degree.

With the structure as shown in FIGS. 1–14, the wrench can be used to thread/unthread an object such as a nut, a bolt or a screw through a plane. During the operation, one of the driving stems is selected as a handle, and the other is selected as the object driving stem according to the specific dimension of the object to be threaded. For example, while threading/unthreading an object with a longer depth, a longer driving stem is selected as the object driving stem and the shorter driving stem is used as the handle rotated to drive the object driving stem. In contrast, when the object to be threaded/unthreaded has a shorter depth, a shorter driving stem is selected as the object driving stem, and a longer driving stem is selected as the handle to result in a large torque for operation.

Figure 15:
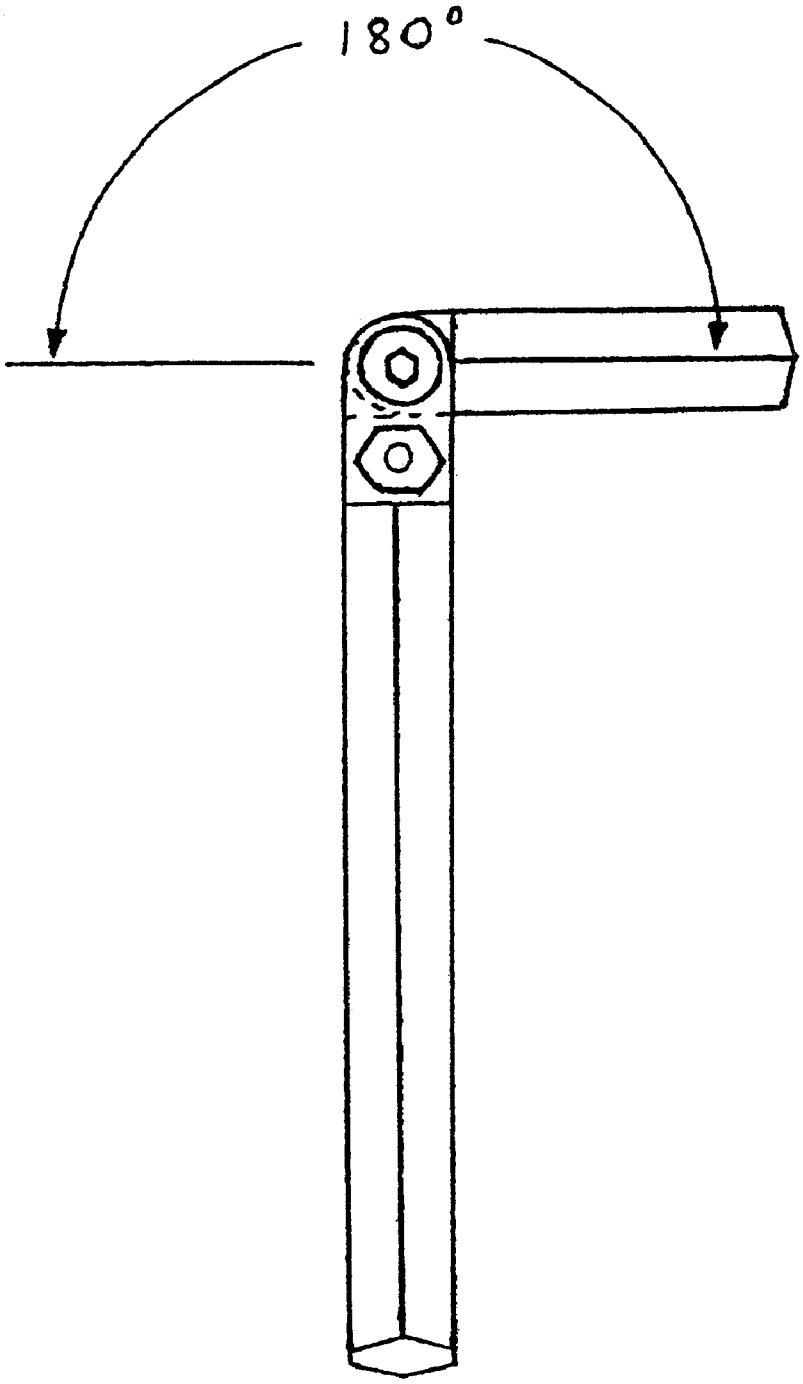
FIG. 15 shows the flipping range of one driving stem with respect to the other driving stem of the wrench provided by the invention.

Preferably, as shown in FIG. 15, the length of the hinge or washer is designed to allow one of the driving stem, for example, the upper driving stem to flip over the lower stem with a flipping range of about 180 degree. That is, the upper driving stem can be flipped from an angle of about 90 degree to an angle of about 270 degree with respect to the lower driving stem. Therefore, when the operation of driving an object is obstructed, the upper driving stem can be lifted up or down to a degree that allows the driving stem used as the handle to rotate continuously without being interrupted until the object is tightened or untightened as required.

Figure 16:
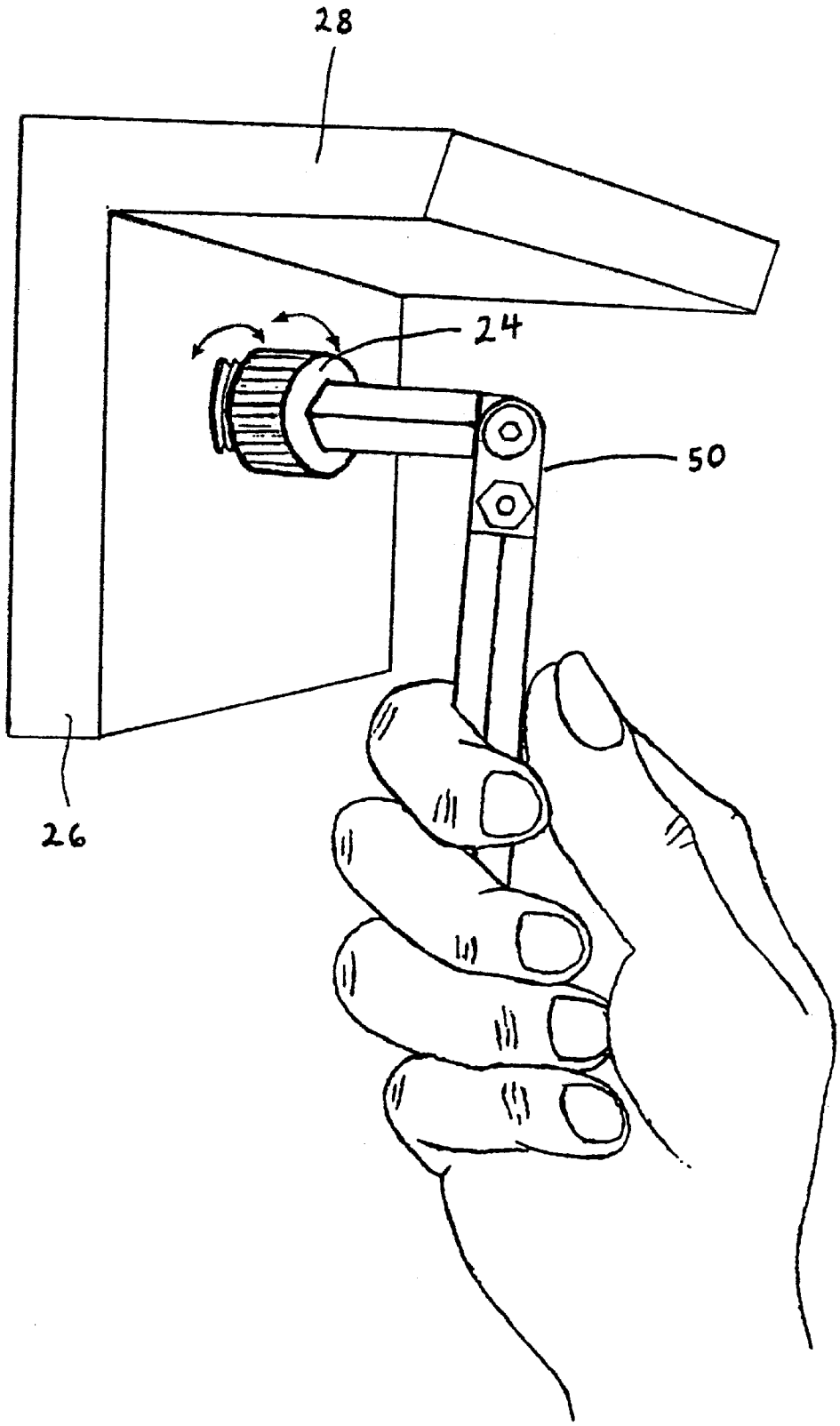
FIG. 16 shows the operation of using the wrench to thread/unthread an object on a plane with the presence of an object protruding from the plane to obstruct operation.
Figure 17:
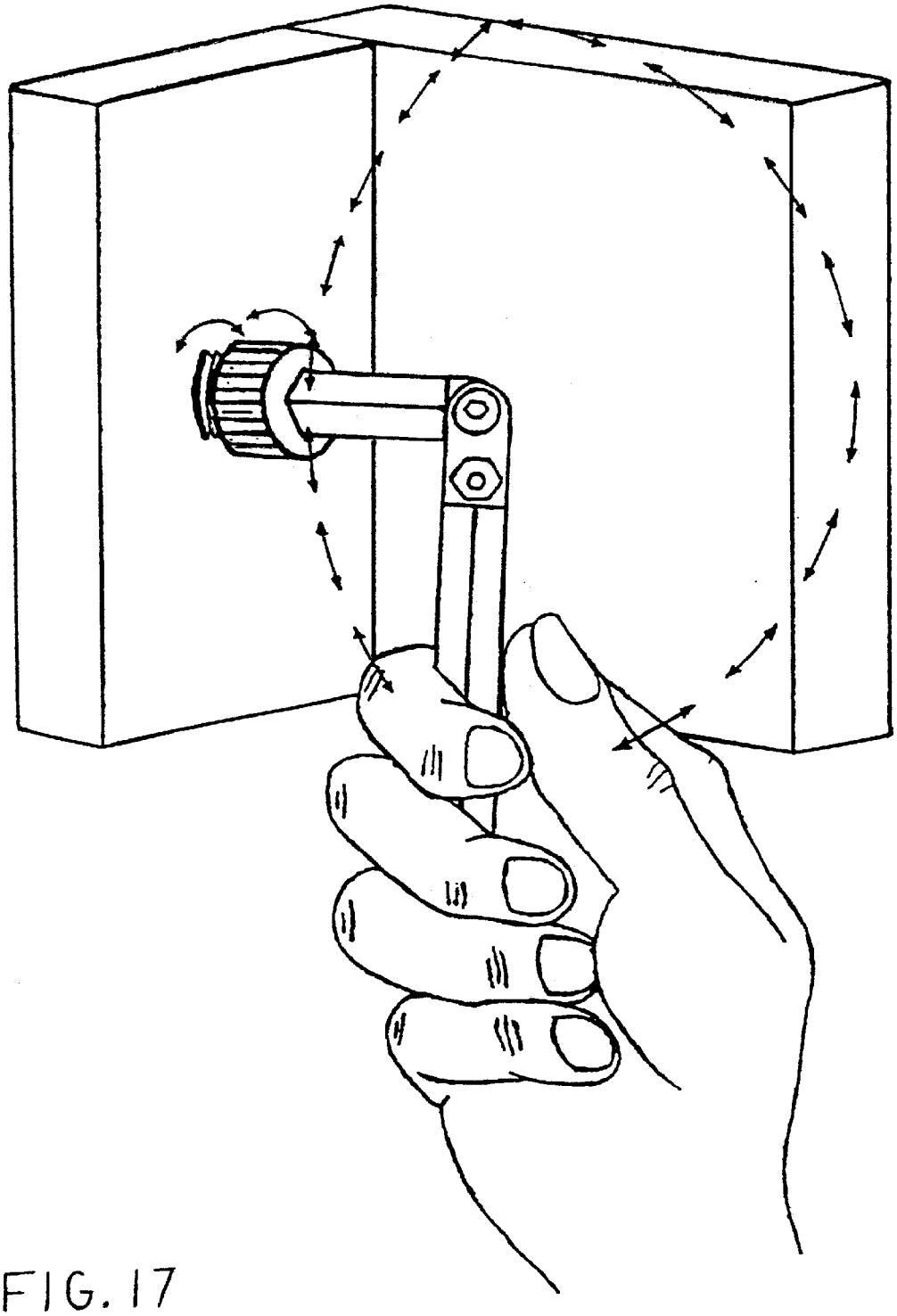
FIG. 17 shows the rotating range and the flipping range of the handle of the wrench with the presence of an object obstructing operation.

FIG. 16 shows a condition for tighten/untighten a nut 24 from a bolt threaded into a plane 26. A plane 28 perpendicularly protrudes from an edge of the plane 26 as shown in the figure. The wrench 50 with the structure as shown in FIGS. 1–14 is used to drive the nut 24 with the plane 28 protruding nearby. If the distance between the nut 24 and the plane 28 is negligible, the driving range of the nut 24, that is, the rotating range of the handle of the wrench 50 is about 180 degree. It is thus difficult to make a full circle turn of the handle using a conventional wrench. As mentioned above, for a conventional wrench, the user has to disengage the nut 24 from the nut driving stem of the wrench first. The handle of the wrench can then be repositioned to repeat the rotation step. However, using the wrench in accordance with the invention, one can simply flip over the handle, so as to reposition the handle to a required position, the rotation of the handle, that is, the tightening/untightening step can be performed continuously. FIG. 17 shows the rotating range and the flipping range of the handle of the wrench provided by the invention.

Figure 18:
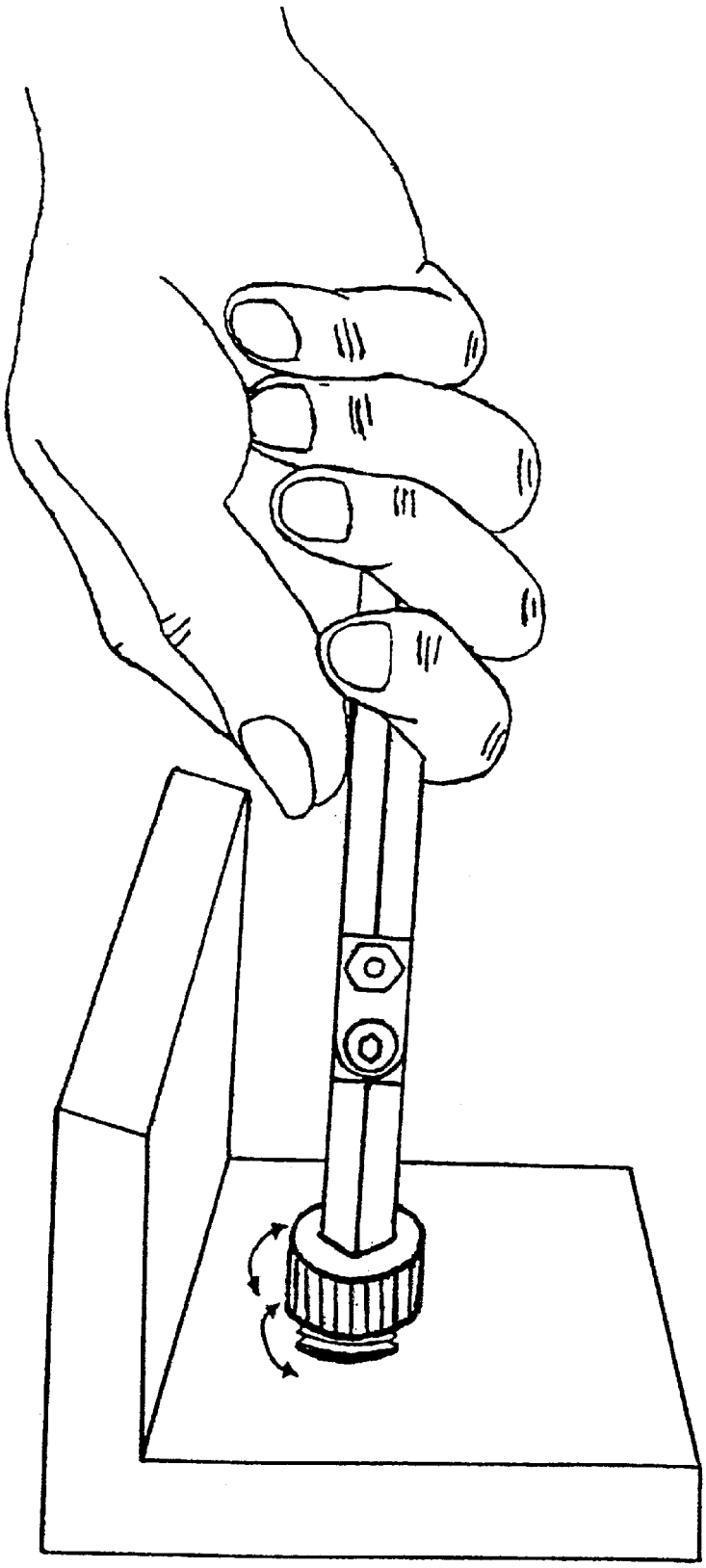
FIG. 18 shows another way of operating under the situation as shown in FIG. 17.

FIG. 18 shows the operation of driving the nut with the handle in line with the nut driving stem. In this manner, even when the peripheral of the nut is completely obstructed, the tightening/untightening action for the nut can still be performed.

Figure 19:
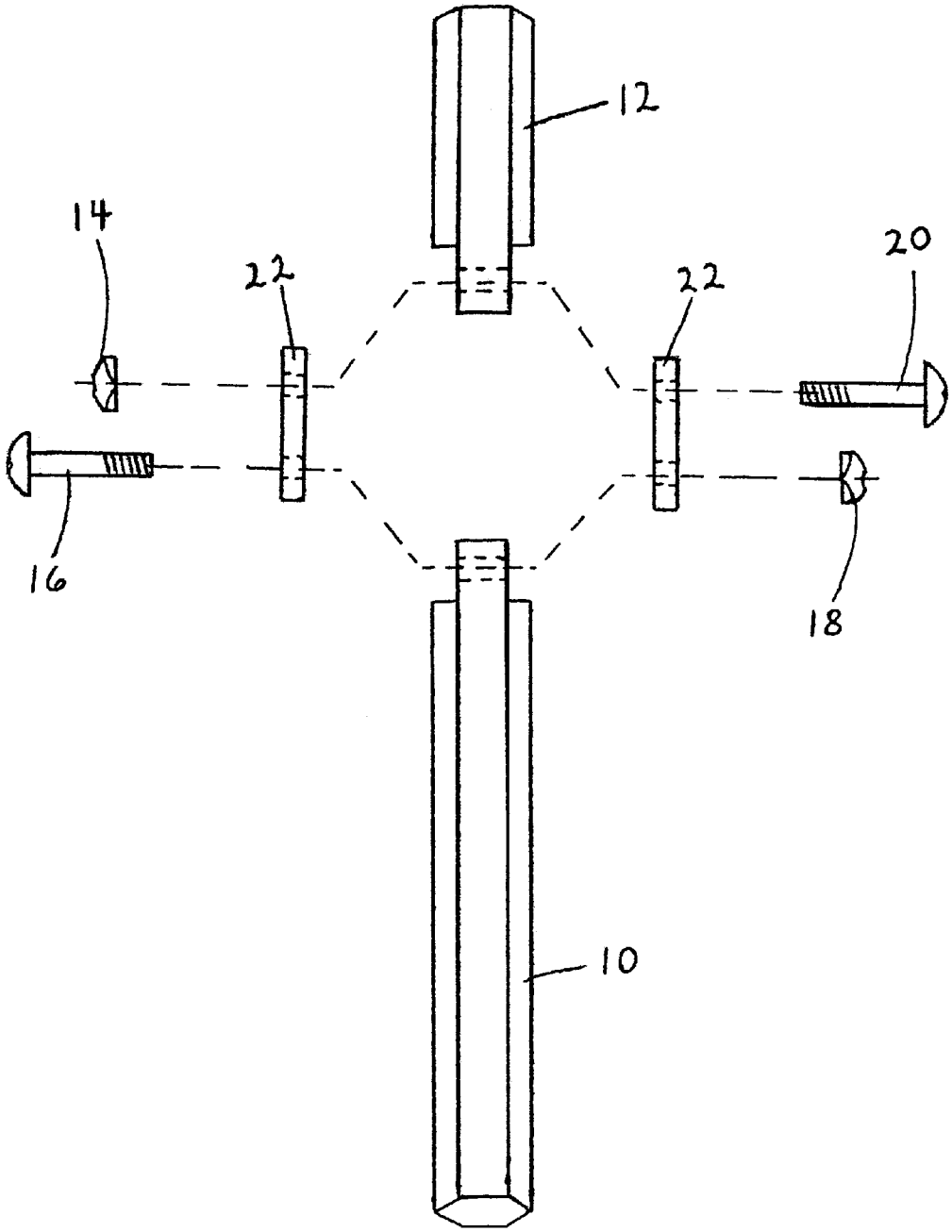
FIG. 19 shows an exploded view of the wrench.

FIG. 19 shows an exploded view showing the connectivity between the upper driving stem 12 and the lower driving stem 10. As shown in this figure, driving stems 10 and 12 are in line with each other. Two sets of bolts 16 and 20, and nuts 14 and 18, and a pair of washers or hinges 22, are used to connect the driving stems 10 and 12. The washers or hinges 22 are connected between the driving stems 10 and 12 with bolts 16 and 20 and nuts 14 and 18 threading through the washer or hinges 22 and the driving stems 10 and 12.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A wrench, comprising:

a first driving stem; and a second driving stem, having one second driving stem first end pivotally connected with one first end of the first driving stem; wherein said first end of first driving stem is connected by a pin joint to a first end of a rigid hinge, wherein said first end of second driving stem is connected to a second end of a rigid hinge; wherein either said first driving stem is capable of operation as a handle to operate said second driving stem, or said second driving stem is capable of operation as a handle to operate said first driving stem, wherein one of the first and the second driving stems can flip over the other driving stem when a user so manually operates, wherein rotation of said first driving stem with respect to said second driving stem allows essentially one pivot axis when either of said driving stems are manually rotated during operation.

2. The wrench according to claim 1, wherein each of the first and second driving stems comprises a hex-key.

3. The wrench according to claim 1, wherein a pair of hinges is used to connected between the ends of the first and the second driving stems.

4. The wrench according to claim 3, wherein two sets of bolts and nuts are threaded through the hinges, the first and the second driving stems.

5. The wrench according to claim 3, wherein the hinge is long enough to allow one of the first and second driving stems to flip with an angle from 90 degree to 270 degree with respect to the other driving stem.

6. The wrench according to claim 1, wherein a flipping range of one of the driving stems with respect to the other driving stem is about 180 degree.

7. The wrench according to claim 1, wherein a flipping range of one of the driving stems with respect to the other driving stem is larger than 180 degree.

8. A wrench, comprising:

A. a first driving stem, comprising further:

a main body; and a flat portion, protruding from the main body with a hole at a center thereof;

b. a second driving stem, comprising further:

a main body; and a flat portion, protruding from the main body with at a center thereof, c. a pair of hinges or washers, each comprising two holes aligned with the holes of the flat portions protruding from the main bodies of the first and the second driving stems, respectively, said holes closely aligned such that rotation of said first driving stem with respect to said second driving stem allows essentially one pivot axis when either of said driving stems are manually rotated during operation; and d. two sets of bolts and nuts, each set being threaded through the holes of the hinges, the flat portion protruding from main bodies of the first and the second driving stems, respectively.

9. The wrench according to claim 8, wherein the first and the second driving stem comprises hex-keys.

10. The wrench according to claim 8, wherein one of the first and the second driving stems has an end with rounded corners to flip over the other driving stem.

11. The wrench according to claim 8, wherein the first and the second driving stems are in different lengths.

12. A pivotal Allen wrench, comprising:

a first hex key driving stem, having one first end with rounded corners; and a second hex key driving stem, having one first end pivotally coupled with said first end with rounded corners of the first hex key driving stem, whereby a user can manually rotate one hex key driving stem relative to the other.

13. The pivotal Allen wrench according to claim 12, wherein the first end with the rounded corners of the first hex-key driving stem and the first end of the second hex key driving stem are pivotally connected by a coupler, said coupler allowing rotation of said first driving stem with respect to said second driving stem in essentially one pivot axis when either of said driving stems are manually rotated during operation.

14. The pivotal Allen wrench according to claim 13, wherein the coupler comprises a hinge and two sets of bolts, and nuts; said hinge capable of receiving two sets of bolts and nuts to form a pin joint allowing rotational motion of said coupler in a single plane with respect to the hex key driving stems.

* * * * *